US011828146B2

(12) United States Patent
Al-Sadhan et al.

(10) Patent No.: US 11,828,146 B2
(45) Date of Patent: Nov. 28, 2023

(54) NONMETALLIC DOWNHOLE CHECK VALVE TO IMPROVE POWER WATER INJECTOR WELL SAFETY AND RELIABILITY

(71) Applicant: SAUDI ARABIAN OIL COMPANY, Dhahran (SA)

(72) Inventors: Saud F. Al-Sadhan, Hofuf (SA); Khaled Ali Al-Sayed, Udhailiyah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 101 days.

(21) Appl. No.: 17/451,440

(22) Filed: Oct. 19, 2021

(65) Prior Publication Data

US 2023/0121121 A1 Apr. 20, 2023

(51) Int. Cl.

| | |
|---|---|
| ***E21B 34/02*** | (2006.01) |
| ***E21B 43/16*** | (2006.01) |
| ***E21B 34/06*** | (2006.01) |

(52) U.S. Cl.

CPC ..... *E21B 43/162* (2013.01); *E21B 34/02* (2013.01); *E21B 34/06* (2013.01); *E21B 2200/04* (2020.05)

(58) Field of Classification Search

CPC ..... E21B 43/162; E21B 43/16; E21B 43/12; E21B 34/02; E21B 33/03

See application file for complete search history.

(56) References Cited

U.S. PATENT DOCUMENTS

| | | | | |
|---|---|---|---|---|
| 2,894,715 | A * | 7/1959 | Bostock | E21B 34/10 92/107 |
| 3,730,273 | A * | 5/1973 | Wilson | E21B 43/162 166/305.1 |
| 4,488,598 | A * | 12/1984 | Duerksen | E21B 43/168 166/266 |
| 5,170,815 | A * | 12/1992 | Going, III | E21B 17/20 137/155 |
| 5,183,075 | A * | 2/1993 | Stein | F16K 17/196 137/512.5 |
| 6,880,639 | B2 | 4/2005 | Rhodes et al. | |
| 8,056,621 | B2 * | 11/2011 | Ring | E21B 19/22 166/88.1 |
| 9,365,271 | B2 * | 6/2016 | Minnock | E21B 34/04 |
| 10,352,123 | B2 * | 7/2019 | Landry | E21B 33/04 |
| 2010/0294506 | A1 * | 11/2010 | Rodriguez | E21B 43/14 166/372 |

(Continued)

FOREIGN PATENT DOCUMENTS

| | | | |
|---|---|---|---|
| CN | 112483065 A | * | 3/2021 |
| CN | 213613308 U | * | 7/2021 |

(Continued)

*Primary Examiner* — Daniel P Stephenson

(74) *Attorney, Agent, or Firm* — Osha Bergman Watanabe & Burton LLP

(57) ABSTRACT

An injection well system is disclosed. The injection well system includes an injection wellhead having a lower master ball valve disposed at a first lower portion of the injection wellhead, an injection wellbore connected to the first lower portion of the injection wellhead, and a nonmetallic check valve disposed below the Earth's surface and at a predetermined location of the injection wellbore, where the nonmetallic check valve, when closed, isolates the injection wellhead from a second lower portion of the injection wellbore.

14 Claims, 4 Drawing Sheets

(56) References Cited

U.S. PATENT DOCUMENTS

| | | | | |
|---|---|---|---|---|
| 2014/0151063 | A1* | 6/2014 | Wright | H01L 27/1266 166/97.1 |
| 2016/0063150 | A1* | 3/2016 | Safonov | E21B 43/16 703/10 |
| 2016/0076347 | A1* | 3/2016 | Diez | E21B 33/04 166/307 |
| 2017/0101849 | A1* | 4/2017 | Silva | E21B 34/10 |
| 2017/0101850 | A1* | 4/2017 | Silva | E21B 33/134 |
| 2019/0128094 | A1* | 5/2019 | Petrie | E21B 25/00 |
| 2019/0316440 | A1* | 10/2019 | Honeker | E21B 47/07 |
| 2020/0340077 | A1* | 10/2020 | Lizama | E21B 43/28 |
| 2021/0140288 | A1* | 5/2021 | Lisk | E21B 34/10 |
| 2022/0145867 | A1* | 5/2022 | Baeuerle | F16K 15/147 |
| 2023/0121121 | A1* | 4/2023 | Al-Sadhan | E21B 34/16 166/373 |

FOREIGN PATENT DOCUMENTS

| | | | | |
|---|---|---|---|---|
| CN | 115749682 | A | * | 3/2023 |
| GB | 2350382 | A | * | 11/2000 |
| WO | WO-2018036683 | A1 | * | 3/2018 |

* cited by examiner

NONMETALLIC DOWNHOLE CHECK VALVE TO IMPROVE POWER WATER INJECTOR WELL SAFETY AND RELIABILITY

BACKGROUND

In the oil and gas industry, a Christmas tree is an assembly of valves, casing spools, and fittings used to regulate the flow of pipes in an oil well, gas well, water injection well, water disposal well, gas injection well, condensate well and other types of wells. An injection well is used to place fluid underground into porous geologic formations. These underground formations may range from deep sandstone or limestone, to a shallow soil layer. Injected fluids may include water, wastewater, brine (salt water), or water mixed with chemicals.

SUMMARY

In general, in one aspect, the invention relates to an injection well system. The injection well system includes an injection wellhead having a lower master ball valve disposed at a first lower portion of the injection wellhead, an injection wellbore connected to the first lower portion of the injection wellhead, and a nonmetallic check valve disposed below the Earth's surface and at a pre-determined location of the injection wellbore, where the nonmetallic check valve, when closed, isolates the injection wellhead from a second lower portion of the injection wellbore.

In general, in one aspect, the invention relates to a well environment. The well environment includes a production well system for retrieving hydrocarbon from a subterranean reservoir, and an injection well system for facilitating said retrieving the hydrocarbon by injecting fluids into the subterranean reservoir. The injection well system includes an injection wellhead having a lower master ball valve disposed at a first lower portion of the injection wellhead, an injection wellbore connected to the first lower portion of the injection wellhead, and a nonmetallic check valve disposed below the Earth's surface and at a pre-determined location of the injection wellbore, where the nonmetallic check valve, when closed, isolates the injection wellhead from a second lower portion of the injection wellbore.

In general, in one aspect, the invention relates to a method for improving reliability of an injection well system. The method includes disposing a lower master ball valve at a first lower portion of an injection wellhead of the injection well system, wherein an injection wellbore is connected to the first lower portion of the injection wellhead, and disposing a nonmetallic check valve below the Earth's surface and at a pre-determined location of the injection wellbore, where the nonmetallic check valve, when closed, isolates the injection wellhead from a second lower portion of the injection wellbore.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
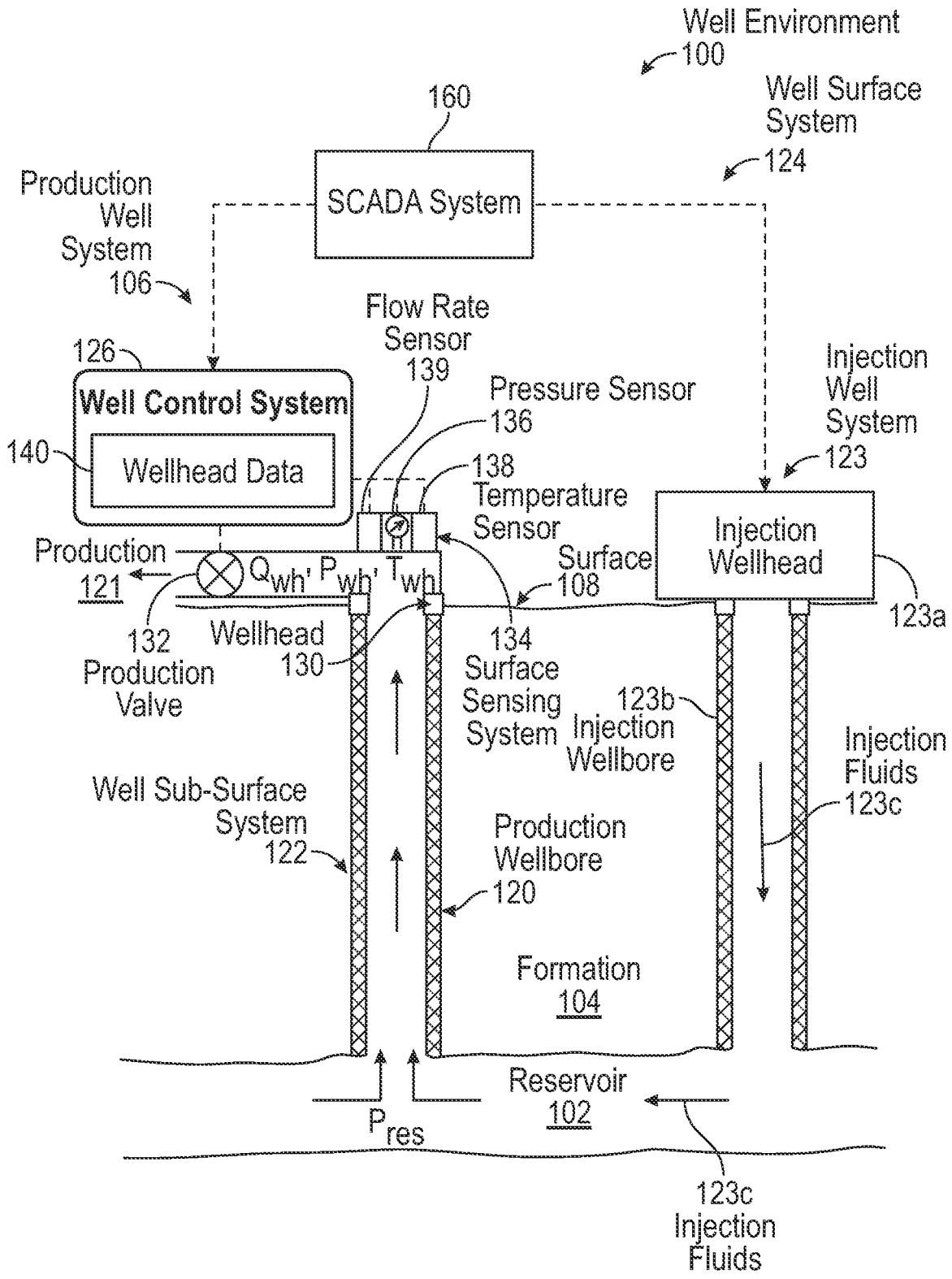
FIGS. 1 and 2 show systems in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of the invention provide a system and a method for an injection well system. In particular, the injection well system includes an injection wellhead having a lower master ball valve disposed at a first lower portion of the injection wellhead, an injection wellbore connected to the first lower portion of the injection wellhead, and a nonmetallic check valve disposed below the Earth's surface (i.e., downhole) and at a pre-determined location of the injection wellbore. In particular, the nonmetallic check valve, when closed, isolates the injection wellhead from a second lower portion of the injection wellbore. In some embodiments, the nonmetallic check valve is closed in response to detecting a reverse flow of pressurized formation fluids in the second lower portion of the injection wellbore, so as to prevent the pressurized formation fluids from reaching the Earth's surface. For example, the reverse flow of pressurized formation fluids may be caused by a pinhole or crack in the injection wellhead and/or the injection wellbore. The pinhole or crack may be created when a localized corrosion induced by corrosive fluids in the injection well system is knocked out by an external force in the well environment. Installing the nonmetallic check valve in a downhole location below the lower master ball valve improves the safety and reliability of the injection well system, especially when the injection well system is used as a power water injector to inject a corrosive fluids (e.g., sea water) into a subterranean reservoir to enhance production of a hydrocarbon well.

FIG. 1 shows a schematic diagram in accordance with one or more embodiments. More specifically, FIG. 1 illustrates a well environment (100) that includes a hydrocarbon reservoir ("reservoir") (102) located in a subsurface formation ("formation") (104), a production well system (106), and an injection well system (123). The formation (104) may include a porous formation that resides underground, beneath the Earth's surface ("surface") (108). In the case of the production well system (106) being a hydrocarbon well, the reservoir (102) may include a portion of the formation (104). The formation (104) and the reservoir (102) may include different layers of rock having varying characteristics, such as varying degrees of permeability, porosity, capillary pressure, and resistivity. In the case of the production well system (106) being operated as a production well, the production well system (106) may facilitate the extraction of hydrocarbons (or "production") from the reservoir (102).

In some embodiments, the production well system (106) includes a production wellbore (120), a well sub-surface system (122), a well surface system (124), and a well control system ("control system") (126). The control system (126) may control various operations of the production well system (106), such as well production operations, well completion operations, well maintenance operations, and reservoir monitoring, assessment and development operations. In some embodiments, the control system (126) includes a computer system that is the same as or similar to that of computer system (400) described below in FIG. 4 and the accompanying description.

The production wellbore (120) may include a bored hole that extends from the surface (108) into a target zone of the formation (104), such as the reservoir (102). An upper end of the production wellbore (120), terminating at or near the surface (108), may be referred to as the "up-hole" end of the production wellbore (120), and a lower end of the wellbore, terminating in the formation (104), may be referred to as the "down-hole" end of the production wellbore (120). The production wellbore (120) may facilitate the circulation of drilling fluids during drilling operations, the flow of hydrocarbon production ("production") (121) (e.g., oil and gas) from the reservoir (102) to the surface (108) during production operations, the injection of substances (e.g., water) into the formation (104) or the reservoir (102) during injection operations, or the communication of monitoring devices (e.g., logging tools) into the formation (104) or the reservoir (102) during monitoring operations (e.g., during in situ logging operations).

In some embodiments, during operation of the production well system (106), the control system (126) collects and records wellhead data (140) for the production well system (106). The wellhead data (140) may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well (106), and water cut data. In some embodiments, the measurements are recorded in real-time, and are available for review or use within seconds, minutes, or hours of the condition being sensed (e.g., the measurements are available within 1 hour of the condition being sensed). In such an embodiment, the wellhead data (140) may be referred to as "real-time" wellhead data (140). Real-time wellhead data (140) may enable an operator of the well (106) to assess a relatively current state of the production well system (106), and make real-time decisions regarding development of the production well system (106) and the reservoir (102), such as on-demand adjustments in regulation of production flow from the well.

In some embodiments, the well sub-surface system (122) includes casing installed in the production wellbore (120). For example, the production wellbore (120) may have a cased portion and an uncased (or "open-hole") portion. The cased portion may include a portion of the wellbore having casing (e.g., casing pipe and casing cement) disposed therein. The uncased portion may include a portion of the wellbore not having casing disposed therein. In embodiments having a casing, the casing defines a central passage that provides a conduit for the transport of tools and substances through the production wellbore (120). For example, the central passage may provide a conduit for lowering logging tools into the production wellbore (120), a conduit for the flow of production (121) (e.g., oil and gas) from the reservoir (102) to the surface (108), or a conduit for the flow of injection substances (e.g., water) from the surface (108) into the formation (104). In some embodiments, the well sub-surface system (122) includes production tubing installed in the production wellbore (120). The production tubing may provide a conduit for the transport of tools and substances through the production wellbore (120). The production tubing may, for example, be disposed inside casing. In such an embodiment, the production tubing may provide a conduit for some or all of the production (121) (e.g., oil and gas) passing through the production wellbore (120) and the casing.

In some embodiments, the well surface system (124) includes a production wellhead (130). The production wellhead (130) may include a rigid structure installed at the "up-hole" end of the production wellbore (120), at or near where the production wellbore (120) terminates at the Earth's surface (108). The production wellhead (130) may include structures (called "wellhead casing hanger" for casing and "tubing hanger" for production tubing) for supporting (or "hanging") casing and production tubing extending into the production wellbore (120). Production (121) may flow through the production wellhead (130), after exiting the production wellbore (120) and the well sub-surface system (122), including, for example, the casing and the production tubing. In some embodiments, the well surface system (124) includes flow regulating devices that are operable to control the flow of substances into and out of the production wellbore (120). For example, the well surface system (124) may include one or more production valves (132) that are operable to control the flow of production (121). For example, a production valve (132) may be fully opened to enable unrestricted flow of production (121) from the production wellbore (120), the production valve (132) may be partially opened to partially restrict (or "throttle") the flow of production (121) from the production wellbore (120), and production valve (132) may be fully closed to fully restrict (or "block") the flow of production (121) from the production wellbore (120), and through the well surface system (124).

In some embodiments, the production wellhead (130) includes a choke assembly. For example, the choke assembly may include hardware with functionality for opening and closing the fluid flow through pipes in the production well system (106). Likewise, the choke assembly may include a pipe manifold that may lower the pressure of fluid traversing the wellhead. As such, the choke assembly may include set of high pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system (126). Accordingly, a well control system (126) may obtain wellhead data regarding the choke assembly as well as transmit one or more commands to components within the choke assembly in order to adjust one or more choke assembly parameters.

Keeping with FIG. 1, in some embodiments, the well surface system (124) includes a surface sensing system (134). The surface sensing system (134) may include sensors for sensing characteristics of substances, including production (121), passing through or otherwise located in the well surface system (124). The characteristics may include, for example, pressure, temperature and flow rate of production (121) flowing through the production wellhead (130), or other conduits of the well surface system (124), after exiting the production wellbore (120).

In some embodiments, the surface sensing system (134) includes a surface pressure sensor (136) operable to sense the pressure of production (121) flowing through the well surface system (124), after it exits the production wellbore (120). The surface pressure sensor (136) may include, for example, a wellhead pressure sensor that senses a pressure of production (121) flowing through or otherwise located in the production wellhead (130). In some embodiments, the surface sensing system (134) includes a surface temperature sensor (138) operable to sense the temperature of production (121) flowing through the well surface system (124), after it exits the production wellbore (120). The surface temperature sensor (138) may include, for example, a wellhead temperature sensor that senses a temperature of production (121) flowing through or otherwise located in the production wellhead (130), referred to as "wellhead temperature" ($T_{wh}$). In some embodiments, the surface sensing system (134) includes a flow rate sensor (139) operable to sense the flow rate of production (121) flowing through the well surface system (124), after it exits the production wellbore (120). The flow rate sensor (139) may include hardware that senses a flow rate of production (121) ($Q_{wh}$) passing through the production wellhead (130).

In some embodiments, the injection well system (123) includes an injection wellhead (123*a*), an injection wellbore (123*b*), and other associated components that are omitted for clarity. The injection wellbore (120) may include a bored hole that extends from the surface (108) into an injection zone of the formation (104) at the peripherals of the reservoir (102). For example, injection fluids (123*c*) may be injected into the injection zone to perform a flooding operation that induces and/or maintains hydrocarbon fluids flowing from the reservoir (120) into the production wellbore (120) as the production (121). The injection well system (123) may be part of a sea water injection system where treated sea water is pumped (injected) into the peripherals of the oil fields under very high pressure (around 2500 psi). The injected sea water exerts pressure on the oil in the reservoir (102) to flow up through the production wellbore (120) and into pipes for transporting to a Gas Oil Separation Plants (GOSP) (not shown). In this context, the injection well system (123) is referred to as a power water injector (PWI).

In some embodiments, the production well system (106) and the injection well system (123) communicate with a supervisory control and data acquisition (SCADA) system (160) using wired and/or wireless data communication networks. The SCADA system (160) is a control system of computers, one of which may be the computing device shown in FIG. 4, networked data communications and graphical user interfaces for gathering and analyzing real time data, such as the wellhead data (140) and other data collected by the production well system (106) and/or the injection well system (123). Specifically, the SCADA system (160) is used to monitor and control the production well system (106) and the injection well system (123). For example, various hydraulic valves, such as the production valve (132) and/or other surface/sub-surface valves of the production well system (106) and the injection well system (123), are remotely controlled using the SCADA system (160). In particular, each hydraulic valve can be closed and/or opened in response to a control signal sent from, or otherwise activated by the SCADA system (160). In one or more embodiments of the invention, the SCADA system (160) is implemented based on the computing system (400) described in reference to FIG. 4 below.

Figure 2:
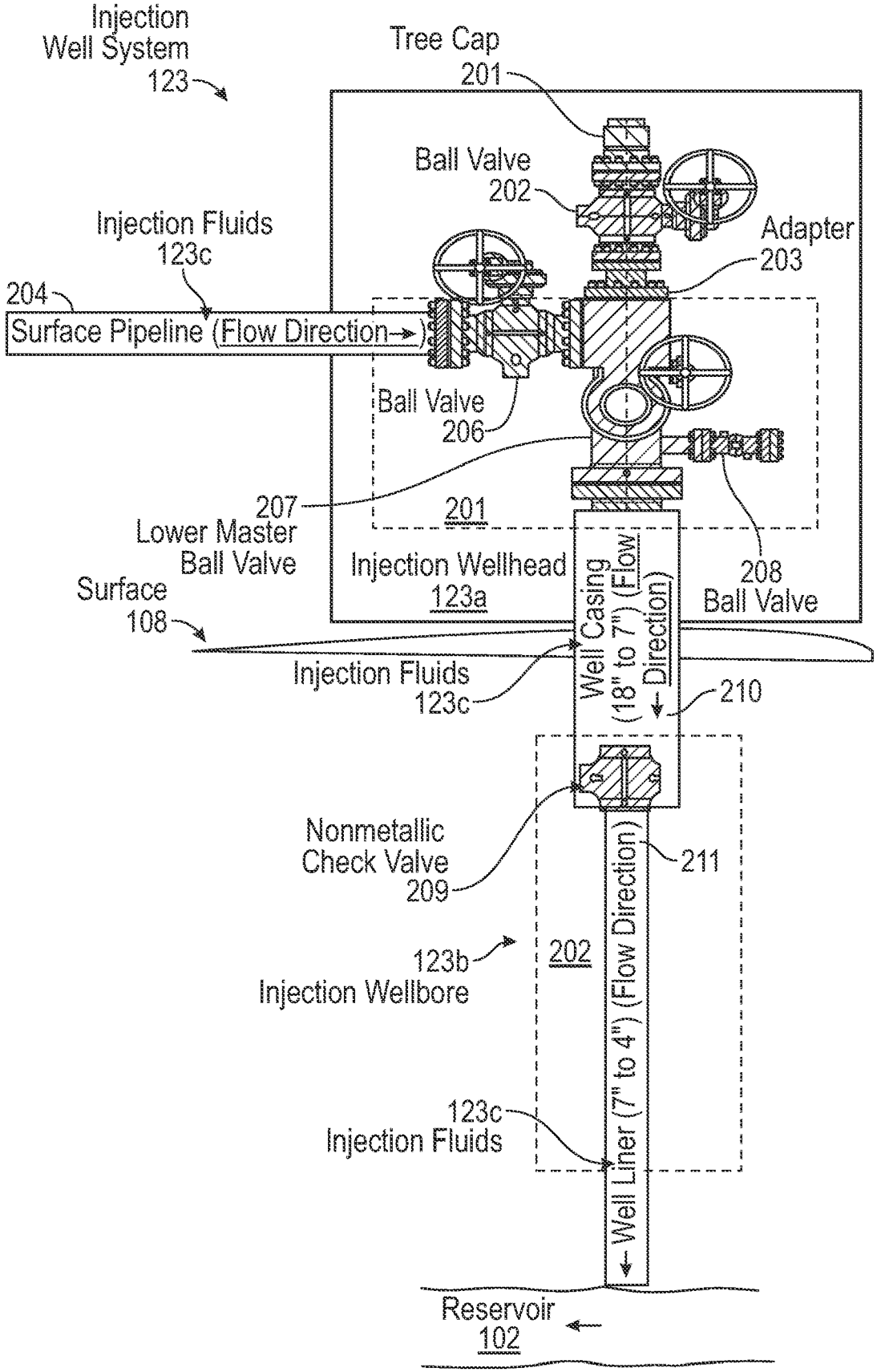

Turning to FIG. 2, FIG. 2 shows a schematic diagram in accordance with one or more embodiments. In one or more embodiments, one or more of the modules and/or elements shown in FIG. 2 may be omitted, repeated, and/or substituted. Accordingly, embodiments of the invention should not be considered limited to the specific arrangements of modules and/or elements shown in FIG. 2.

FIG. 2 illustrates details of the injection well system (123) depicted in FIG. 1 above. As shown in FIG. 2, the injection wellhead (123*a*) is a Christmas tree assembly of connectors, valves, spools, tubing and fittings. Specifically, the Christmas tree assembly includes a tree cap (201), a first ball valve (202), an adapter (203), a second ball valve (206), a lower master ball valve (207), and a third ball valve (208). Ball valves are quarter-turn valves to control the on-off flow of fluids. The lower master ball valve (207) is located at a lower portion (201) (e.g., the lowest point) of the wellhead (123*a*) and is referred to as such. The lower master ball valve (207), when closed, isolates the injection wellbore (123*b*) from other components of the injection wellhead (123*a*). The lower master ball valve (207), when opened, allows the injection wellbore (123*b*) to be coupled to the tree cap (201), the surface pipeline (204), and other pipelines (not shown) via the first ball valve (202), the second ball valve (206), and the third ball valve (208), respectively. In particular, when the second ball valve (206) is opened, the injection fluids (123*c*) is allowed to flow from the surface pipeline (204) into the injection wellbore (123*b*) before being injected into the reservoir (102).

The completion of the injection wellbore (123*b*) includes a well casing (210) and a well liner (211) that are coupled via a nonmetallic check valve (209). For example, the well casing (210) may have a diameter between 18 inches to 7 inches and the well liner (211) may have a diameter between 7 inches to 4 inches. The nonmetallic check valve (209) improves the safety and reliability of the injection well system (123) as the PWI using sea water or other corrosive injection fluids. Specifically, the nonmetallic check valve (209) eliminates possible uncontrolled surface leaks of pressurized formation fluids coming from the underground section of the PWI, such as the lower portion (202) of the injection wellbore (123*b*). In particular, the nonmetallic check valve (209) prevents a flowback (reverse flow) scenario from the reservoir (102) back to the surface (108) due to a pinhole or crack anywhere in the injection wellhead (123*a*) and/or the injection wellbore (123*b*). The pinhole or crack may be created when a localized corrosion in a piping section or wellhead is knocked out due to external force common in the well environment (100). Such reverse flow of pressurized formation fluids results in loss of containment that incurs prohibitive loss of production and emergency response expenses, such as emergency rig, overheads, material, etc.

In an example scenario, the nonmetallic check valve (209) is placed between the well casing (210) and the well liner (211) to accommodate the diameter difference using a packer seal. In another example scenario, the well liner (211) is threaded to engage the nonmetallic check valve (209). In either scenario, a rig-less operation is performed to install the nonmetallic check valve (209) by accessing the injection wellbore (123*b*) from the tree cap (201). During the rig-less operation, a lubricator is used to install the nonmetallic check valve (209) inside the well at the lower portion (202) of the injection wellbore (123*b*). In particular, the lubricator is mounted on the well and moved to the targeted downhole section (where the new nonmetallic check valve is to be located) through the wellhead starting from the tree cap (201), ball valve (206) and ball valve (207). The new nonmetallic check valve (209) is retrievable hardware and is installed in the well casing (210). Specifically, the new nonmetallic check valve (209) may be set below the packer (or liner hanger) of the well liner (211). The new nonmetallic check valve (209) may be set using a landing nipple.

When fluid leaks occur below the lower master ball valve (207), the injection wellbore (123*b*) will not be approachable due to the huge volume of liquid leaking from underground. Therefore, an emergency rig may be mobilized to perform a well kill operation. A well kill is the operation of placing a column of heavy fluid into a well bore in order to prevent the flow of reservoir fluids without pressure control equipment at the surface. The nonmetallic check valve (209) is resistant to corrosion from the sea water or other corrosive injection fluids. Accordingly, the nonmetallic check valve (209) acts as an essential reservoir isolation means to the PWI in addition to the lower master ball valve (207) such that the well kill operation may be prevented.

In the case of any malfunction of the nonmetallic check valve (209), wireline operations may be performed for a retrieval or milling activity that replaces the malfunctioned check valve with a new one if required. In particular, the lubricator is mounted on the well and moved to the downhole section through the wellhead starting from the tree cap (201), ball valve (206) and ball valve (207) to either disengage (unscrew) or mill the nonmetallic check valve (209).

Figure 3:
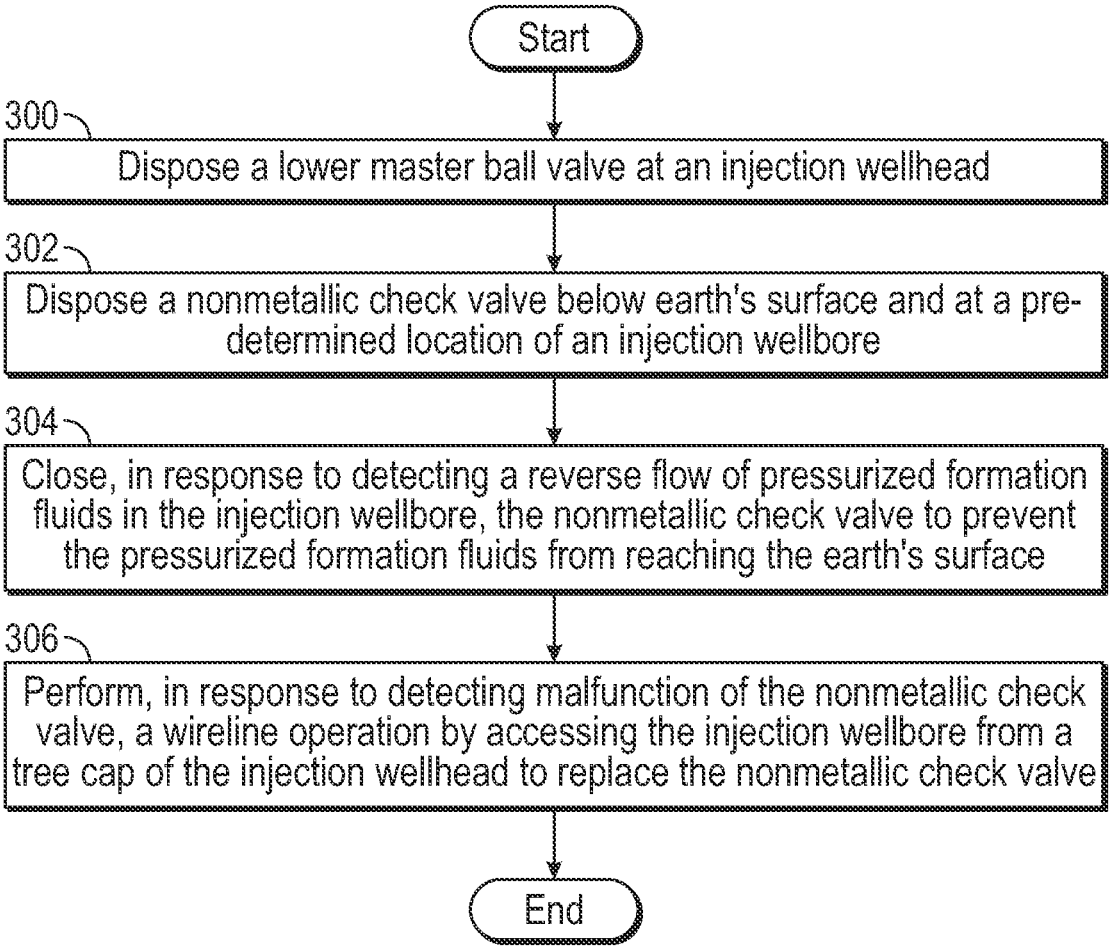
FIG. 3 shows a flowchart in accordance with one or more embodiments.

FIG. 3 shows a flowchart in accordance with one or more embodiments. One or more blocks in FIG. 3 may be performed using one or more components as described in FIGS. 1 and 2. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially in Block 300, a lower master ball valve is disposed at a lower portion of an injection wellhead of an injection well system, where an injection wellbore is connected to the lower portion of the injection wellhead.

In Block 302, a nonmetallic check valve is disposed below the Earth's surface (i.e., downhole) and at a predetermined location of the injection wellbore. In some embodiments, the nonmetallic check valve is disposed between a well casing and a well liner of the injection wellbore. In some embodiments, a rig-less operation is performed to install the nonmetallic check valve by accessing the injection wellbore from a tree cap of the injection wellhead.

In Block 304, in response to detecting a reverse flow of pressurized formation fluids in a lower portion of the injection wellbore, the nonmetallic check valve is closed to prevent the pressurized formation fluids from reaching the Earth's surface. Specifically, when the nonmetallic check valve, the injection wellhead is isolated from the lower portion of the injection wellbore. In some embodiments, the reverse flow of pressurized formation fluids is detected using a sensor in the injection wellbore and/or the injection wellhead. In some embodiments, detecting the reverse flow of pressurized formation fluids and closing the nonmetallic check valve are performed manually. In other embodiments, a signal indicating the detected reverse flow may be sent to the SCADA system using wired and/or wireless data communication networks. Accordingly, the SCADA system in turns sends a command to close the nonmetallic check valve.

In Block 306, in response to detecting a malfunction of the nonmetallic check valve, a wireline operation is performed by accessing the injection wellbore from the tree cap of the injection wellhead to replace the malfunctioned nonmetallic check valve.

Embodiments disclosed herein significantly improve Seawater Power Water Injector Well safety and reliability, and eliminate the possibility to have uncontrolled surface leaks by installation of a nonmetallic downhole check valve. The objective of this modification is to prevent a flowback scenario from the reservoir back to the surface in the event of pinhole or crack on the section located downstream the lower mater manual isolation valve. This credible scenario might occur whenever this is a localized corrosion in the subject piping section.

Figure 4:
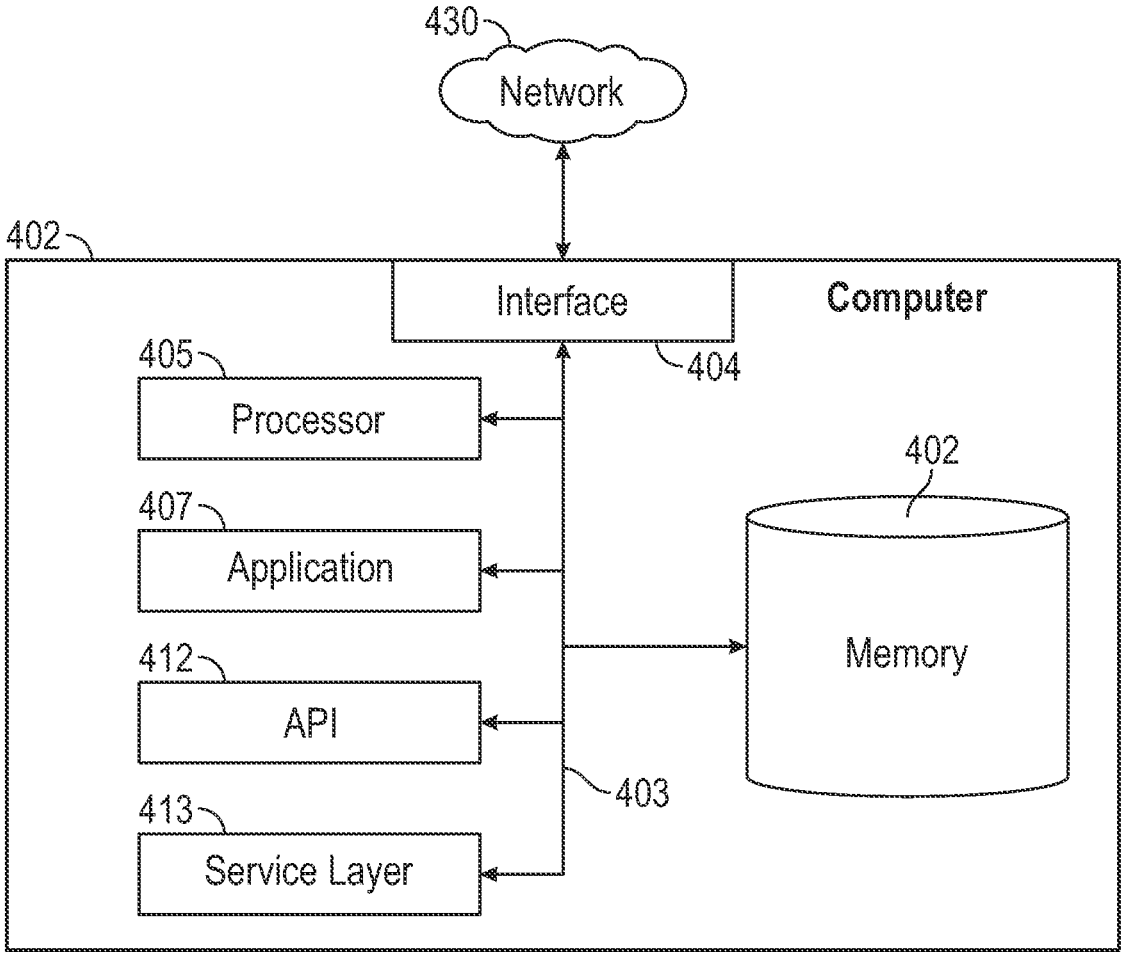
FIG. 4 shows a computing system in accordance with one or more embodiments.

Embodiments may be implemented on a computer system. FIG. 4 is a block diagram of a computer system (402) used to provide computational functionalities associated with described algorithms, methods, functions, processes, flows, and procedures as described in the instant disclosure, according to an implementation. The illustrated computer (402) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402)) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or other suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), each computer (402) communicating over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

In some embodiments, the computer (402) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed is:

1. An injection well system, comprising:

an injection wellhead having a lower master ball valve disposed at a first lower portion of the injection wellhead;

an injection wellbore connected to the first lower portion of the injection wellhead; and a nonmetallic check valve disposed below the Earth's surface and at a pre-determined location of the injection wellbore, wherein the nonmetallic check valve, when closed, isolates the injection wellhead from a second lower portion of the injection wellbore, wherein the nonmetallic check valve is closed, in response to detecting a reverse flow of pressurized formation fluids in the second lower portion of the injection wellbore, to prevent the pressurized formation fluids from reaching the Earth's surface, and wherein the reverse flow of pressurized formation fluids is caused by a pinhole in the injection wellhead and/or the injection wellbore.

2. The injection well system of claim 1, wherein the pinhole is created when a localized corrosion in the injection wellhead and/or the injection wellbore collapses due to an external force.

3. The injection well system of claim 1, wherein the nonmetallic check valve is disposed between a well casing and a well liner of the injection wellbore.

4. The injection well system of claim 3, wherein the nonmetallic check valve uses a packer seal to accommodate a diameter difference between the well casing and the well liner.

5. The injection well system of claim 3, wherein the well liner is threaded to engage the nonmetallic check valve.

6. A well environment, comprising:

a production well system for retrieving hydrocarbon from a subterranean reservoir; and an injection well system for facilitating said retrieving the hydrocarbon by injecting fluids into the subterranean reservoir, the injection well system comprising:

an injection wellhead having a lower master ball valve disposed at a first lower portion of the injection wellhead;

an injection wellbore connected to the first lower portion of the injection wellhead; and a nonmetallic check valve disposed below the Earth's surface and at a pre-determined location of the injection wellbore, wherein the nonmetallic check valve, when closed, isolates the injection wellhead from a second lower portion of the injection wellbore, wherein the nonmetallic check valve is closed, in response to detecting a reverse flow of pressurized formation fluids in the second lower portion of the injection wellbore, to prevent the pressurized formation fluids from reaching the Earth's surface, and wherein the reverse flow of pressurized formation fluids is caused by a pinhole in the injection wellhead and/or the injection wellbore.

7. The well environment of claim 6, wherein the pinhole is created when a localized corrosion in the injection wellhead and/or the injection wellbore collapses due to an external force.

8. The well environment of claim 6, wherein the nonmetallic check valve is disposed between a well casing and a well liner of the injection wellbore.

9. The well environment of claim 8, wherein the nonmetallic check valve uses a packer seal to accommodate a diameter difference between the well casing and the well liner.

10. The well environment of claim 9, wherein the well liner is threaded to engage the nonmetallic check valve.

11. A method for improving reliability of an injection well system, the method comprising:

disposing a lower master ball valve at a first lower portion of an injection wellhead of the injection well system, wherein an injection wellbore is connected to the first lower portion of the injection wellhead;

disposing a nonmetallic check valve below the Earth's surface and at a pre-determined location of the injection wellbore, wherein the nonmetallic check valve, when closed, isolates the injection wellhead from a second lower portion of the injection wellbore; and closing, in response to detecting a reverse flow of pressurized formation fluids in the second lower portion of the injection wellbore, the nonmetallic check valve to prevent the pressurized formation fluids from reaching the Earth's surface, wherein the reverse flow of pressurized formation fluids is caused by a pinhole in the injection wellhead and/or the injection wellbore.

12. The method of claim 11, wherein said disposing the nonmetallic check valve comprises:

performing a rig-less operation to install the nonmetallic check valve by accessing the injection wellbore from a tree cap of the injection wellhead.

13. The method of claim 12, wherein the nonmetallic check valve is disposed between a well casing and a well liner of the injection wellbore.

14. The method of claim 13, further comprising:

detecting a malfunction of the nonmetallic check valve; and performing, in response to said detecting the malfunction of the nonmetallic check valve, a wireline operation by accessing the injection wellbore from a tree cap of the injection wellhead to replace the nonmetallic check valve.

* * * * *